US005831392A

United States Patent [19]

Hansen et al.

[11] Patent Number: 5,831,392

[45] Date of Patent: Nov. 3, 1998

[54] DEVICE FOR CONDITIONING CONTROL SIGNAL TO ELECTRON EMITTER, PREFERABLY SO THAT COLLECTED ELECTRON CURRENT VARIES LINEARLY WITH INPUT CONTROL VOLTAGE

[75] Inventors: Ronald L. Hansen, San Jose; Christopher J. Spindt, Menlo Park; John E. Field, Santa Cruz, all of Calif.

[73] Assignee: Candescent Technologies Corporation, San Jose, Calif.

[21] Appl. No.: 739,404

[22] Filed: Oct. 31, 1996

[51] Int. Cl.[6] ..... G09G 3/10

[52] U.S. Cl. ..... 315/169.1; 315/291; 315/307; 345/98; 345/100

[58] Field of Search ..... 345/98, 100; 327/308, 327/323, 324, 364; 315/169.1, 291, 307

[56] References Cited

U.S. PATENT DOCUMENTS

| | | | |
|---|---|---|---|
| 4,306,775 | 12/1981 | Delapierre et al. | 350/363 |
| 5,103,144 | 4/1992 | Dunham | 315/366 |
| 5,103,145 | 4/1992 | Doran | 315/381 |
| 5,218,273 | 6/1993 | Kane et al. | 315/326 |
| 5,462,467 | 10/1995 | Macaulay et al. | 445/50 |
| 5,541,548 | 7/1996 | Crafts | 327/364 |
| 5,559,389 | 9/1996 | Spindt et al. | 313/310 |
| 5,564,959 | 10/1996 | Spindt et al. | 445/24 |
| 5,734,366 | 3/1998 | Kubota et al. | 345/100 |

OTHER PUBLICATIONS

Brodie et al, "Vacuum Microelectronics," *Advances In Electronics And Electron Physics,* vol. 83, 1992, pp. 1–106.

Busta, "Vacuum Microelectronics—1992," *J. Micromech. Microeng.,* vol. 2, 1992, pp. 43–74.

Goede, "Digital Address Thin Display Tube," Northrop Corp./NTIS, Nov. 1974, pp. 1–134.

*Primary Examiner*—Robert J. Pascal
*Assistant Examiner*—Michael Shingleton
*Attorney, Agent, or Firm*—Skjerven, Morrill, MacPherson, Franklin & Friel LLP; Ronald J. Meetin

[57] ABSTRACT

A voltage-adjustment section (20) of an electronic device converts an input control voltage ($V_1$) into an output control voltage ($V_0$) in such a way that a collector current ($I_{CP}$) form with electrons emitted from an emitter (EP) of an emission/collection cell (26), or triode, varies in a desired, typically linear, manner with the input control voltage. The triode further includes a collector (CP) that carries the collector current and a gate electrode (GP) that regulates the collector current as a function of the output control voltage. Control of the collector current so as to achieve the desired current/voltage relationship is achieved with an analog control loop containing the triode and an amplifier (28) coupled between the triode's collector and gate electrode. The triode thus typically has a linear gamma characteristic relative to the input control voltage. The voltage-adjustment section is suitable for use in a display device such as a flat-panel display.

30 Claims, 7 Drawing Sheets

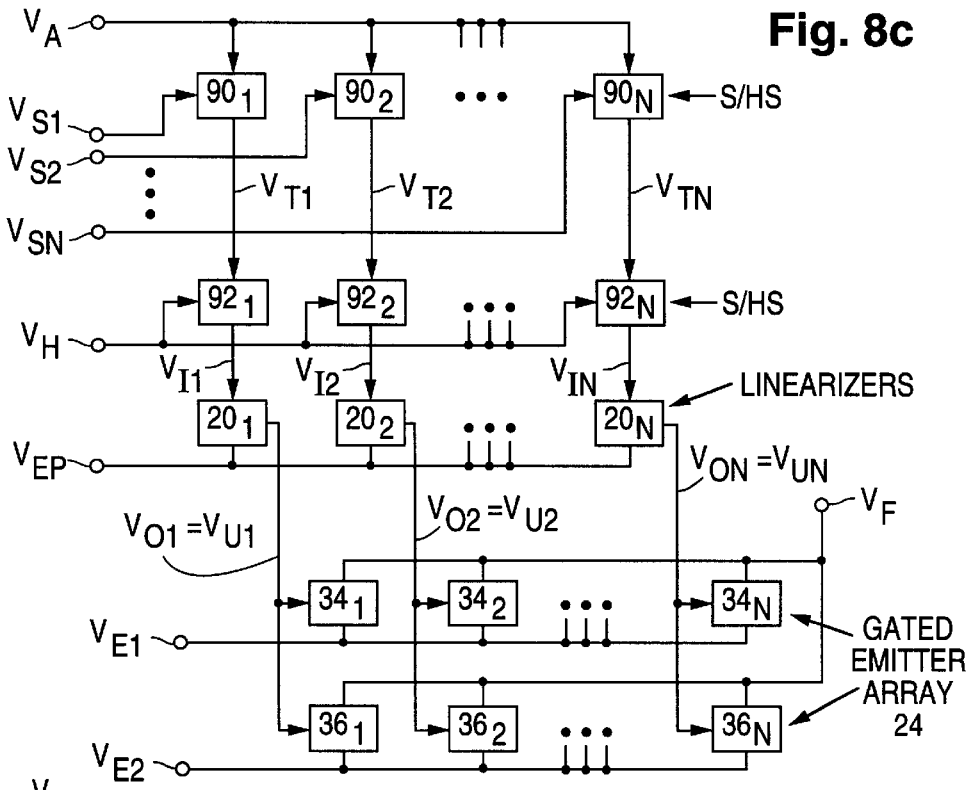
Fig. 8c
$V_A$
$V_{S1}$
$V_{S2}$
$V_{SN}$
$90_1$
$90_2$
$90_N$
S/HS
$V_{T1}$
$V_{T2}$
$V_{TN}$
$92_1$
$92_2$
$92_N$
S/HS
$V_H$
$V_{I1}$
$V_{I2}$
$V_{IN}$
LINEARIZERS
$20_1$
$20_2$
$20_N$
$V_{EP}$
$V_{ON} = V_{UN}$
$V_F$
$V_{O1} = V_{U1}$
$V_{O2} = V_{U2}$
$34_1$
$34_2$
$34_N$
$V_{E1}$
GATED EMITTER ARRAY 24
$36_1$
$36_2$
$36_N$
$V_{E2}$

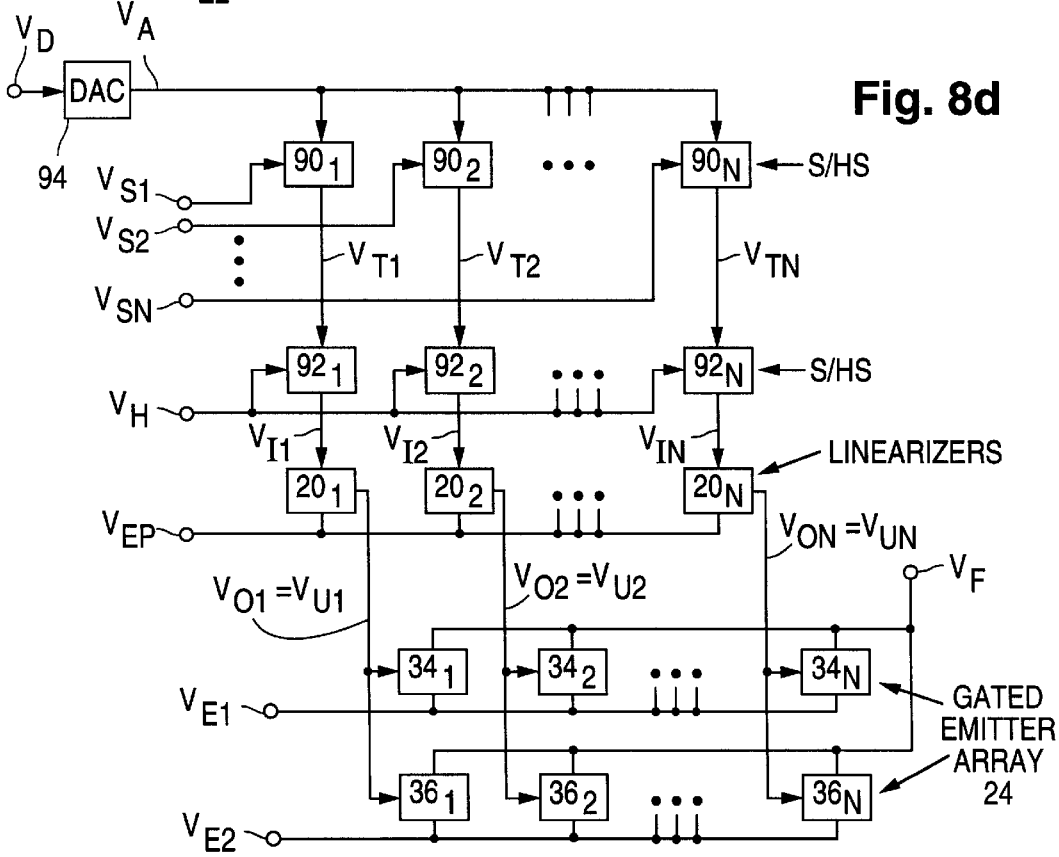
Fig. 8d
$V_D$
$V_A$
DAC
94
$V_{S1}$
$V_{S2}$
$V_{SN}$
$90_1$
$90_2$
$90_N$
S/HS
$V_{T1}$
$V_{T2}$
$V_{TN}$
$92_1$
$92_2$
$92_N$
S/HS
$V_H$
$V_{I1}$
$V_{I2}$
$V_{IN}$
LINEARIZERS
$20_1$
$20_2$
$20_N$
$V_{EP}$
$V_{ON} = V_{UN}$
$V_F$
$V_{O1} = V_{U1}$
$V_{O2} = V_{U2}$
$34_1$
$34_2$
$34_N$
$V_{E1}$
GATED EMITTER ARRAY 24
$36_1$
$36_2$
$36_N$
$V_{E2}$

DEVICE FOR CONDITIONING CONTROL SIGNAL TO ELECTRON EMITTER, PREFERABLY SO THAT COLLECTED ELECTRON CURRENT VARIES LINEARLY WITH INPUT CONTROL VOLTAGE

FIELD OF USE

This invention relates to electron emission. In particular, this invention relates to conditioning signals that control electron emission in devices such as flat-panel displays of the field-emission cathode-ray tube ("CRT") type.

BACKGROUND ART

A field-emission flat-panel CRT display is a relatively thin electronic device in which a group of electron emitters, collectively referred to as the cathode, are situated over the interior surface of a baseplate. The electron emitters are arranged in a matrix of rows and columns of picture elements (pixels) to form the active area of the display. Each pixel typically contains a large number of individual electron-emissive elements. When the electron-emissive elements are suitably excited, they emit electrons into space. The electron emission is controlled in such a manner that the emitted electrons strike light-emissive material arranged in corresponding pixels situated over the interior surface of a faceplate.

The faceplate in a field-emission flat-panel CRT display, commonly termed a field-emission display ("FED"), usually consists of transparent material such as glass. Upon being struck by electrons emitted from electron-emissive elements in the FED, the light-emissive material overlying the faceplate's interior surface emits light visible on the faceplate's exterior surface. By appropriately controlling the electron flow from the electron-emissive elements to the light-emissive material, a suitable image is visible on the faceplate. In a color FED, each light-emissive pixel contains light-emissive subpixels that emit blue, red, and green light upon being struck by electrons emitted from corresponding electron-emissive subpixels formed over the baseplate.

The emission of electrons from the electron-emissive elements in each pixel (or subpixel) of the FED is controlled by applying a suitable voltage to a gate electrode situated over the electron-emissive elements. Another voltage is applied directly to the electron-emissive elements in each pixel by way of an emitter electrode. Electron emission occurs when the gate-to-emitter voltage—i.e., the voltage applied to the gate electrode minus the voltage applied to the electron-emissive elements through the emitter electrode—exceeds a threshold level. Directing the electrons to the corresponding light-emissive pixel (or subpixel) is provided for by applying a high voltage to a collector, also referred to as the anode, situated over the interior surface of the faceplate next to the light-emissive material. The gate electrode thus extracts electrons from the electron-emissive elements and determines the magnitude of the electron current, while the collector controls the direction of the electron current.

The electron-emissive elements, the gate electrode, and the collector form a triode as shown in the prior art drawing of FIG. 1. Element E in FIG. 1 represents an electron emitter, consisting of one or more electron-emissive elements, to which emitter voltage signal $V_E$ is applied. Element G is a gate electrode which receives gate voltage signal $V_G$. Element C is a collector that carries collector current $I_C$ consisting of electrons emitted from emitter E. Inasmuch as some of the emitted electrons typically do not reach collector C, current $I_C$ represents the effective amount of electron emission.

FIG. 2 illustrates the relationship, commonly referred to as the gamma characteristic, between collector current $I_C$ and the gate-to-emitter voltage $V_G$-$V_E$. Above a threshold value $V_T$ of gate-to-emitter voltage $V_G$-$V_E$, collector current $I_C$ increases with increasing $V_G$-$V_E$. Unfortunately, the gamma characteristic is highly non-linear. That is, collector current $I_C$ varies non-linearly with gate-to-emitter voltage $V_G$-$V_E$ according to the Fowler-Nordheim relationship. This creates difficulty in controlling the brightness of the FED. To improve control over the FED brightness, efforts have been undertaken to create an approximately linear relationship between the display brightness and a control signal that regulates the collected electron current and thus the display brightness.

Doran, U.S. Pat. No. 5,103,145, discloses a digital apparatus for causing the brightness of an FED to vary in an approximately linear manner with an input control voltage. In Doran, the electron emitters form pixels allocated into cells, each containing the same number of electron emitters. The cells of each pixel are, in turn, allocated into cell groups, each containing a different number of cells. For example, Doran presents an example in which a pixel contains fifteen cells with four electron emitters in each cell. The fifteen cells are allocated into four groups, one containing eight cells, another containing four cells, a third containing two cells, and the last containing one cell.

When turned on, everyone of the electron emitters in Doran operates at substantially the same emissive level as every other turned-on electron emitter. An analog input video signal is supplied to an analog-to-digital converter to produce a digital signal that causes the electron emitters in a selected number of the cell groups to turn on. The number of cells having electron emitters that turn on corresponds to the value of the digital signal. If the digital signal is nine in the example where there are groups of eight cells, four cells, two cells, and one cell in each pixel, the electron emitters in the groups with eight cells and one cell turn on. Accordingly, the brightness of the pixel varies in a piecewise linear manner corresponding to the value of the analog input signal.

Doran's linearization technique would appear adequate for applications where few levels of quantization are adequate. However, the technique is relatively complex. Doran's circuitry could be prone to fabrication difficulty, especially in providing the wiring that defines the cell groups in each pixel. Improving the linearization entails increasing the number of cell groups and thus the amount of wiring that must be placed in a relatively small area. Consequently, the technique becomes harder to implement as the linearization improves. Manufacturing tolerances could detrimentally affect the accuracy of the lower quantization levels. It would be desirable to have a simple technique for enabling the collected electron current of a gated electron emitter to vary linearly with a control signal utilized to adjust the electron current, especially for applications such as FEDs.

GENERAL DISCLOSURE OF THE INVENTION

The present invention employs a relatively simple analog control loop to set up a desired relationship, typically a largely linear one, between an electron current and an input control voltage that can be adjusted to change the magnitude of the electron current. The electron current is formed with electrons emitted into space by an emitter in the analog control loop. In addition to the electron emitter, the control loop contains a collector and a gate electrode. The collector directly produces the electron current by collecting electrons emitted from the emitter. The gate electrode, which in combination with the electron emitter forms a gated electron emitter, controls the collected electron current as a function of an output control voltage provided in response to the input control voltage.

Importantly, the output control voltage is generated at substantially whatever value is needed to establish the desired, typically linear, relationship between the collected electron current and the input control voltage. The output control voltage can thus be utilized in controlling the electron current in another gated emitter such as one employed in the active display area of a field-emission display. When the collected electron current of the gated emitter in the control loop varies linearly with the input control voltage, the electron current of a gated emitter in the active display area also typically varies linearly with the input control voltage. Since the brightness of an FED varies directly with the electron current collected from gated electron emitters in the active area, the invention enables the display brightness to be regulated as an approximately linear function of the input control voltage.

More particularly, in accordance with the invention, a voltage-adjusting section of an electronic device converts an input control voltage into an output control voltage. The voltage-adjusting section contains an input portion, an emission/collection cell, and an amplifier. In response to the input control voltage, the input portion provides an input control current to an input node. The input portion is typically formed with a resistor coupled between the input node and a section input terminal which receives the input control voltage. When so formed, the input control current varies in an approximately linear manner with the input control voltage.

The emission/collection cell has an emitter, a collector, and a gate electrode that together form a triode in the control loop. The emitter, which is coupled to a source of an emitter reference voltage and which is typically formed with multiple electron-emissive elements, emits electrons into space. The collector is coupled to the input node for carrying a collector current formed with electrons emitted from the emitter. The gate electrode controls the collector current as a function of the output control voltage.

The amplifier, also part of the control loop, has a pair of input terminals and an output terminal. One of the amplifier input terminals is coupled to the input node. The other amplifier input terminal is coupled to a source of an amplifier reference voltage. The amplifier output terminal is coupled to the gate electrode of the emission/collection cell in the control loop. The amplifier amplifies the difference between the signals at the amplifier input terminals to produce the output control voltage at the amplifier output terminal.

The amplifier, typically an operational amplifier, normally has a high gain. As a result, the input control current approximately equals the collector current of the emission/collection cell in the control loop. Also, the high gain of the amplifier allows it to provide the output control voltage at a suitable value, typically a value that varies non-linearly with the input control voltage, for enabling the gate electrode of the emission/collection cell to extract sufficient electrons from its emitter so that the collector current varies approximately linearly with the input control voltage. In this way, the control loop of the invention provides a seemingly linear gamma characteristic.

In a typical application, the electronic device of the invention includes an additional emission/collection cell having an emitter, a collector, and a gate electrode. The emitter of the additional cell emits electrons into space. The collector carries a collector current formed with electrons emitted from the emitter. The gate electrode, which forms a gated emitter with the emitter of the additional cell, controls the collector current as a function of the output control voltage.

The output control voltage can be employed in various ways to control the collector current of the additional emission/collection cell. For example, the output control voltage can be provided directly to the gate electrode of the additional cell. Alternatively, the output control voltage can be converted into a related additional control voltage provided to the gate electrode of the additional cell.

Regardless of which of the preceding techniques is employed, the collector current of the additional emission/collection cell typically varies with the input control voltage in approximately the same manner that the collector current of the emission/collection cell in the control loop varies with the input control voltage. When the variation is linear in the control loop, the collector current of the additional cell varies linearly with the input control voltage. This enables the brightness of an FED that utilizes the additional emission/collection cell to vary linearly with the input control voltage. In short, the invention provides a simple, readily implementable technique for seemingly linearizing the gamma characteristic in an FED.

BRIEF DESCRIPTION OF THE DRAWINGS

FIGS. 8*a*, 8*b*, 8*c*, 8*d*, 8*e*, 8*f*, 8*g*, and 8*h* are block diagrams of eight implementations of signal conditioning circuitry that converts a video input signal into gate voltages for a gated emitter array utilizing one or more implementations of the voltage-adjustment section of FIG. 3.

Figure 1:
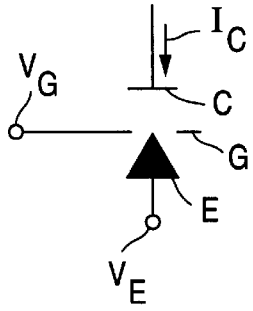
Fig. 1 PRIOR ART
FIG. 1 is a circuit diagram of a conventional triode.
Figure 2:
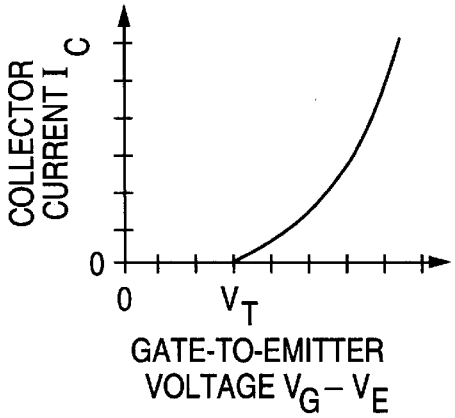
Fig. 2 PRIOR ART
FIG. 2 is a graph of the gamma characteristic for the triode of FIG. 1.

Like reference signals are employed in the drawings and in the description of the preferred embodiments to represent the same, or very similar, item or items.

DESCRIPTION OF THE PREFERRED EMBODIMENTS

Figure 3:
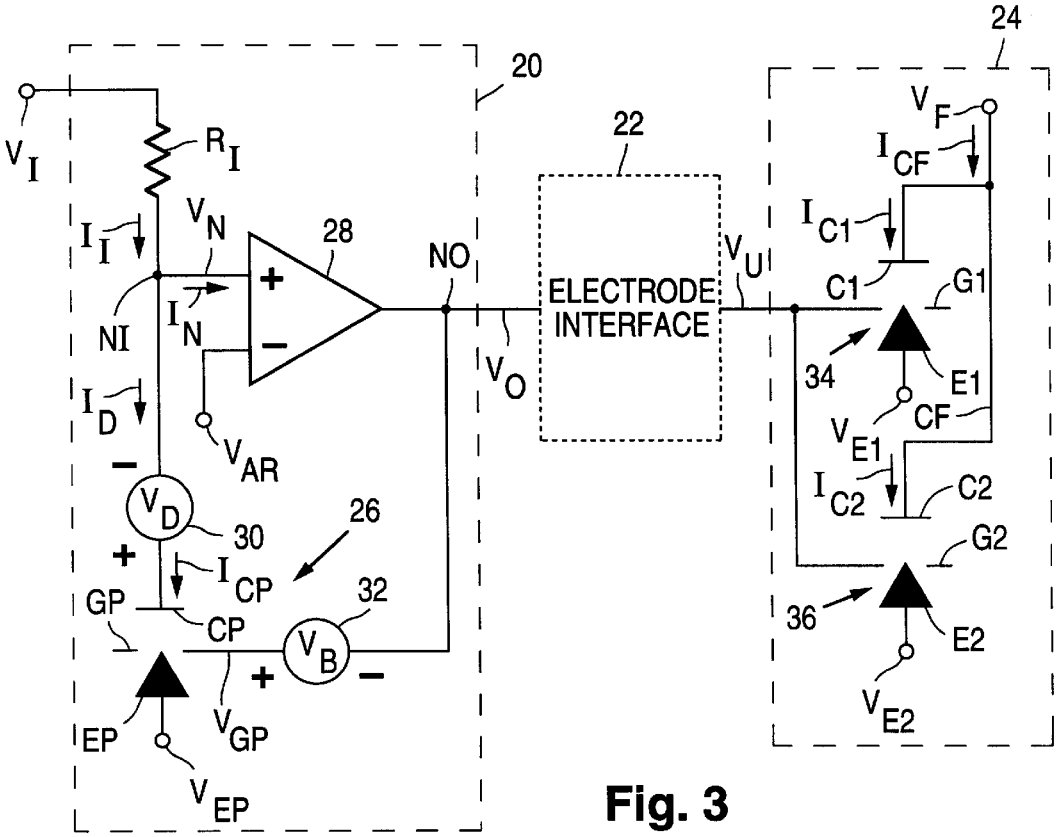
FIG. 3 is a circuit diagram of an electronic device containing a voltage-adjustment section which employs an analog control loop in accordance with the invention to produce a seemingly linearized gamma characterized for a triode.

Referring to FIG. 3, it illustrates signal-conditioning circuitry containing a voltage-adjustment section 20 arranged according to the teachings of the invention to produce a seemingly linear gamma characteristic for a gated electron emitter of an electronic element such as a triode. The signal-conditioning circuitry of FIG. 3 is typically employed in a highly evacuated display device such as an FED. Nonetheless, the signal-conditioning circuitry of FIG. 3 can also be utilized in other evacuated devices, such as linear amplifiers, that employ field-emission cathodes.

Voltage-adjustment linearization section 20 converts an input control voltage signal $V_I$, into an output control voltage signal $V_O$ that varies in an appropriate non-linear manner with input control voltage $V_I$ so as to produce a seemingly linear gamma characteristic for the gated electron emitter. Output control voltage $V_O$ is provided to an optional electrode interface 22 that produces a related additional control voltage signal $V_U$. If electrode interface 22 is absent, additional control voltage $V_U$ is identical to output control voltage $V_O$. Additional control voltage $V_U$ is employed to drive an array 24 of gated electron emitters. Electron emitter array 24 typically forms the active area of an FED.

Returning to linearization section 20, it contains an input resistor $R_I$, a primary emission/collection cell 26, and an operational amplifier 28. Input resistor $R_I$ is connected between an input node NI and a section input terminal at which linearizer 20 receives input control voltage $V_I$. Resistor $R_I$ converts input control voltage $V_I$ into an input control current $I_I$. In particular, input control circuit $I_I$ is given as:

$$I_I=(V_I-V_N)/R_I \tag{1}$$

where $V_N$ is the input nodal voltage at input node NI. Primary emission/collection cell 26 and operational amplifier 28 are arranged in an analog control loop that provides a linear gamma characteristic for primary cell 26 relative to input control voltage $V_I$.

Primary emission/collection cell 26 is a vacuum triode formed with a primary electron emitter EP, a primary gate electrode GP, and a primary collector CP. The pressure in emission/collection cell 26 is at a high vacuum level of no greater than $10^{-2}$ torr, preferably $10^{-5}$ torr or less. Electron emitter EP, which typically consists of multiple electron-emissive elements, receives a substantially constant primary emitter reference voltage VEP. A primary gate voltage signal $V_{GP}$ is supplied to gate electrode GP. Collector CP carries a primary collector current $I_{CP}$ formed with electrons emitted by emitter EP into space.

Gate electrode GP extracts electrons from electron emitter EP to produce collector current $I_{CP}$. The value of collector electron current $I_{CP}$ is controlled by gate voltage $V_{GP}$, more specifically, gate-to-emitter voltage $V_{GP}$-$V_{EP}$. Collector current $I_{CP}$ varies in a non-linear manner with gate-to-emitter voltage $V_{GP}$-$V_{EP}$ according to the Fowler-Nordheim relationship.

Collector CP is coupled to input node NI through an optional source 30 of a substantially constant collector bias voltage $V_D$. An intermediate current $I_D$ flows from input node NI to collector bias voltage source 30. Collector current $I_{CP}$ is identical to intermediate current $I_D$ when bias voltage source 30 is absent. When voltage source 30 is present, collector current $I_{CP}$ is preferably largely equal to intermediate current $I_D$. Consequently, voltage source 30 adjusts the voltage level at collector CP without significantly changing the current level.

Operational amplifier 28 has an inverting input terminal that receives a substantially constant amplifier reference voltage $V_{AR}$, a non-inverting input terminal connected to input node NI at nodal voltage $V_N$, and an output terminal connected to an output node NO. Amplifier 28 amplifies the difference between input nodal voltage $V_N$ at the non-inverting amplifier input terminal and amplifier reference voltage $V_{AR}$ at the inverting amplifier input terminal to produce output control voltage $V_O$ at the amplifier output terminal.

Output node NO, at which output voltage $V_O$ is present, is coupled to gate electrode GP of triode 26 through an optional source 32 of a substantially constant gate bias voltage $V_B$. The analog control loop of the invention is thus formed by (a) the coupling of collector CP through optional collector bias source 30 to the non-inverting input terminal of amplifier 28 and (b) the coupling of the amplifier output terminal through optional gate bias voltage source 32 to gate electrode GP. Bias voltages $V_D$ and $V_B$ can be set at values independent of each other.

When gate bias voltage source 32 is absent, gate voltage $V_{GP}$ is identical to output control voltage $V_O$. When voltage source 32 is present, gate voltage $V_{GP}$ is given as:

$$V_{GP}=V_O+V_B \tag{2}$$

Consequently, voltage source 32 serves to shift the voltage level of gate electrode GP relative to output control voltage $V_O$. Regardless of whether voltage source 32 is present or not, a change in output voltage $V_O$ produces a substantially equal change in gate voltage $V_{GP}$. Gate electrode GP thus controls collector current $I_{CP}$ as a function of output voltage $V_O$.

Operational amplifier 28 has a gain of at least 1000, typically greater than 100,000. A current $I_N$ flows from input node NI to the non-inverting input terminal of amplifier 28. Due to the high amplifier gain, current $I_N$ is normally negligible compared to input control current $I_I$. Consequently, intermediate current $I_D$ approximately equals input control current $I_I$. Since collector current $I_{CP}$ equals, or largely equals, intermediate current $I_D$, collector current $I_{CP}$ approximately equals input control current $I_I$.

The high gain of amplifier 28 also causes input nodal voltage $V_N$ to be approximately equal to amplifier reference voltage $V_{AR}$. With input control current $I_I$ being given by Eq. 1, the net result is that collector current $I_{CP}$ is given as:

$$I_{CP}\approx(V_I-V_{AR})/R_I,\ I_{CP}\geqq 0 \tag{3}$$

In Eq. 3, collector current $I_{CP}$ varies in an approximately linear manner with input control voltage $V_I$. The control loop in linearizing section 20 causes triode 26 to have a linear gamma characteristic relative to input control voltage $V_I$.

The reference point for the gamma characteristic of a triode is the voltage applied to the triode's emitter. In linearizing section 20, emitter reference voltage $V_{EP}$ is substantially constant and thus differs from substantially constant amplifier reference voltage $V_{AR}$ by a substantially constant amount. Let the substantially constant voltage difference $V_{AR}$-$V_{EP}$ be represented as $V_{TI}$. Eq. 3 for positive collector current $I_{CP}$ can then be expressed as:

$$I_{CP}\approx(V_I-V_{EP})/R_I-V_{TI}/R_I,\ I_{CP}\geqq 0 \tag{4}$$

where voltage difference $V_I$-$V_{EP}$ is the input-to-emitter voltage. Voltage $V_{TI}$ is the input-to-emitter threshold voltage at which triode 26 turns on. That is, voltage $V_{TI}$ is the threshold value of input-to-emitter voltage $V_I$-$V_{EP}$ at which an increase in voltage $V_I$-$V_{EP}$ causes collector current $I_{CP}$ to rise above zero.

Figure 4:
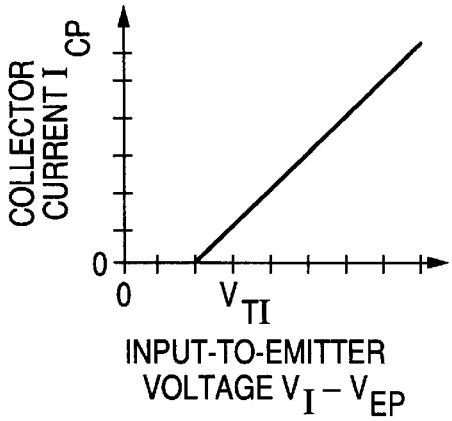
FIG. 4 is a graph of a seemingly linearized gamma characteristic for the triode in the device of FIG. 3.

Eq. 4 for linearizing circuit 20 is graphically illustrated in FIG. 4. Although collector current $I_{CP}$ varies non-linearly with gate-to-emitter voltage $V_{GP}$-$V_{EP}$ in accordance with the Fowler-Nordheim relationship, the control loop of linearizing section 20 causes collector current $I_{CP}$ to have an approximately linear variation with input-to-emitter voltage $V_I$-$V_{EP}$. The control loop thus linearizes the gamma characteristic with respect to input control voltage $V_I$ that controls collector current $I_{CP}$.

It is typically desirable that collector current $I_{CP}$ be zero when input control voltage $V_I$ is zero. From Eq. 3, this condition arises when amplifier reference voltage $V_{AR}$ is zero (ground reference). From Eq. 4, threshold voltage $V_{TI}$ equals $-V_{EP}$ at this condition.

Due to the high amplifier gain, amplifier 28 generates output control voltage $V_O$ at substantially whatever value is needed for gate electrode GP to extract sufficient electrons from emitter EP to produce collector current $I_{CP}$ that satisfies Eq. 3 or 4. As mentioned above, gate-to-emitter voltage $V_{GP}$-$V_{EP}$ varies non-linearly with collector current $I_{CP}$ according to the Fowler-Nordheim relationship. A change in gate-to-emitter voltage $V_{GP}$-$V_{EP}$ thus varies in a non-linear manner with a change in collector current $I_{CP}$ according to the Fowler-Nordheim relationship.

Output control voltage $V_O$ either equals gate voltage $V_{GP}$ or differs from gate voltage $V_{GP}$ by constant gate bias voltage $V_B$. In either case, a change in output voltage $V_O$ varies non-linearly with a change in collector current $I_{CP}$ according to the Fowler-Nordheim relationship. This makes output voltage $V_O$ suitable for controlling other gated electron emitters so that their electron currents vary in an approximately linear manner with input control voltage $V_I$.

Gated emitter array 24 in FIG. 3 contains a plurality of gated display emitters of which two such gated emitters 34 and 36 are shown. Gated display emitter 34 is an emission cell consisting of a display electron emitter E1 and a display gate electrode G1. Gated display emitter 36 similarly is an emission cell consisting of a display electron emitter E2 and a display gate electrode G2. As with primary emitter EP in triode 26, each of display emitters E1 and E2 typically consist of multiple electron-emissive elements. The combination of emitter E1 and gate electrode G1, or the combination of emitter E2 and gate electrode G2, is substantially identical physically to the combination of emitter EP and gate electrode GP in triode 26.

Display emitter voltage signals $V_{E1}$ and $V_{E2}$, which are typically varied to selectively turn display emitters E1 and E2 on and off, are respectively provided to emitters E1 and E2. Additional control voltage signal $V_U$ is furnished as a display gate voltage to both of gate electrodes G1 and G2 for controlling the extraction of electrons from emitters E1 and E2 dependent on the values of emitter voltages $V_{E1}$ and $V_{E2}$. Gate electrodes G1 and G2 can be (a) separate electrodes, (b) separate but interconnected electrodes, or (c) a single electrode.

Gated display emitter 34 is illustrated in FIG. 3 as having a display collector Cl that carries a display collector current $I_{C1}$ formed with electrons emitted from display emitter E1. Gated display emitter 36 is similarly shown as having a display collector C2 that carries a display collector current $I_{C2}$ formed with electrons emitted from display emitter E2. As indicated below, display collectors C1 and C2 are normally situated a substantial distance away from combinations E1/G1 and E2/G2. Elements E1, G1, and C1 together form a display emission/collection cell. Elements E2, G2, and C2 likewise form a display emission/collection cell. The pressure in each of display emission/collection cells E1/G1/C1 and E2/G2/C2 is typically at the same high vacuum level as in primary emission/collection cell EP/GP/GP.

Collectors C1 and C2 can be separate electrodes. Collectors C1 and C2 can, as well, be part of a single collector (or anode) CF connected to a source of a substantially constant collector voltage $V_F$. In this case, collector CF carries a display collector current $I_{CF}$ that equals the sum of collector currents $I_{C1}$ and $I_{C2}$ and the collector currents from the other gated emitters in array 24.

Output voltage $V_O$ controls gated emitters 34 and 36 in the following way. Since elements E1 and G1 in a gated emitter 34 are substantially identical physically to elements EP and GP in triode 26, collector current $I_{C1}$ for gated emitter 34 varies non-linearly with display gate-to-emitter voltage $V_U$-$V_{E1}$ according to the Fowler-Nordheim relationship in largely the same way that collector current $I_{CP}$ varies with gate-to-emitter voltage $V_{GP}$-$V_{EP}$ in triode 26. The same applies to the non-linear variation of display collector current $I_{C2}$ with gate-to-emitter voltage $V_U$-$V_{E2}$ for gated display emitter 36. That is, each of display emission/collection cells E1/G1/C1 and E2/G2/C2 has substantially the same gamma characteristic as primary emission/collection cell EP/GP/CP.

Consider what happens when electrode interface 22 is absent so that additional control voltage/display gate voltage $V_U$ equals output control voltage $V_O$. Assume that display emitter voltages $V_{E1}$ and $V_{E2}$, while adjustable so as to control the on/off operation of gated emitters 34 and 36, are temporarily set at specific values that cause emitters 34 and 36 to emit electrons. For example, if primary emitter voltage $V_{EP}$ is set at such a value that gate bias voltage $V_B$ is zero, display emitter voltages $V_{E1}$ and $V_{E2}$ can be set equal to $V_{EP}$.

A change in display collector current $I_{C1}$due to a change in input control voltage $V_I$ varies non-linearly with a change in gate-to-emitter voltage $V_U$-$V_{EI}$ in largely the same way that primary collector current $I_{CP}$ changes non-linearly due to an accompanying change in gate-to-emitter voltage $V_{GP}$-$V_{EP}$. The same applies to display collector current $I_{C2}$ as it varies non-linearly with gate-to-emitter voltage $V_U$-$V_{E2}$ due to a change in input voltage $V_I$. Because gate voltage $V_{GP}$ in triode 26 is provided at a value that enables collector current $I_{CP}$ to vary approximately linearly with input voltage $V_I$, appropriate choice of values for display emitter voltages $V_{E1}$ and $V_{E2}$ as, for example, given in the previous paragraph enables collector currents $I_{C1}$ and $I_{C2}$ to vary approximately linearly with input voltage $V_I$.

The situation is substantially the same when electrode interface 22 is present, provided that a change in additional control voltage/display gate voltage $V_U$ approximately equals a change in output control voltage $V_O$. Since each of display emission/collection cells E1/G1/C1 and E2/G2/C2 has substantially the same gamma characteristic as primary emission/collection cell EP/GP/CP (i.e., triode 26), changes in collector currents $I_{C1}$ and $I_{C2}$ due to a change in input voltage $V_I$ vary respectively in a non-linear manner with changes in gate-to-emitter voltages $V_U$-$V_{E1}$ and $V_U$-$V_{E2}$ in substantially the same way that a change in collector current $I_{CP}$ varies non-linearly with a change in primary gate voltage $V_{GP}$. With appropriate choice for the values of emitter voltages $V_{E1}$ and $V_{E2}$, the variation of each of collector currents $I_{C1}$ and $I_{C2}$ with input voltage $V_I$ is approximately linear.

Figure 5:
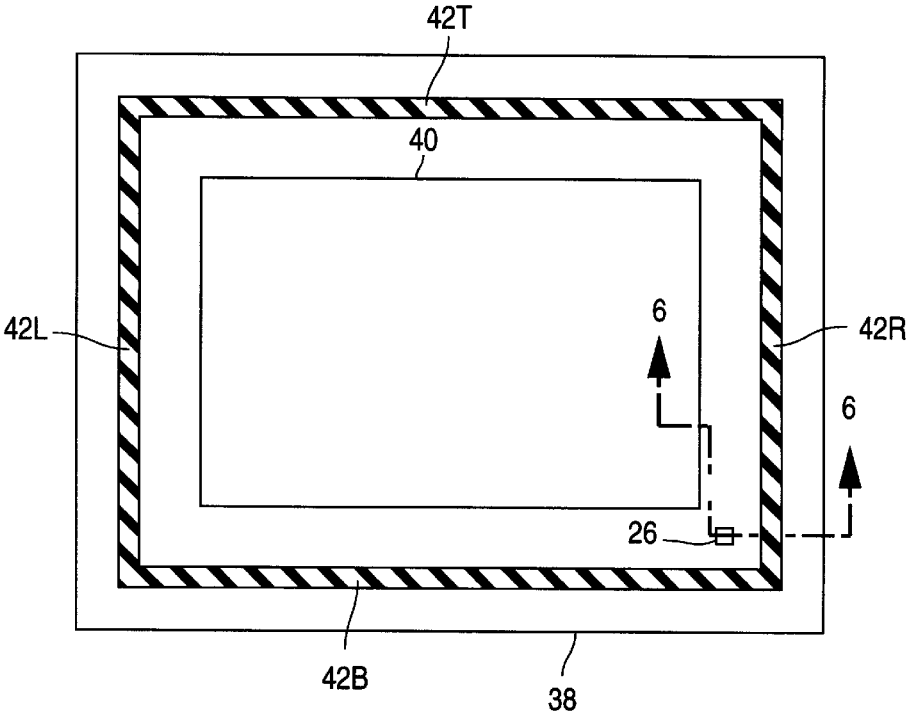
FIG. 5 is a plan view of a baseplate structure of an FED that employs the voltage-adjustment section of FIG. 3. The plan view of FIG. 5 is taken through an outer wall through which the baseplate structure is sealed to a faceplate structure.

FIG. 5 depicts a typical internal plan view of a baseplate structure in an FED that utilizes a single implementation of linearizing section 20. The baseplate structure consists of a rectangular electrically insulating baseplate 38 plus various layers and other elements provided over the interior and exterior surfaces of baseplate 38. Of these layers and other elements, FIG. 5 only illustrates the location for active display area 40 and one potential location for triode 26. Gated display emitter combinations E1/G1 and E2/G2 (not shown in FIG. 5), plus the other gated display emitters, form active area 40.

The plan view of FIG. 5 is taken through an outer wall through which the baseplate structure is hermetically sealed to a faceplate structure (not shown in FIG. 5) to form a vacuum enclosure at a pressure of no greater than $10^{-2}$ torr, preferably $10^{-5}$ torr or less. The outer wall consists of a left wall 42L, a right wall 42R, a bottom wall 42B, and a top wall 42T (collectively "42"). As shown in FIG. 5, triode 26 is situated at a location between active area 40 and outer wall 42.

Input resistor $R_I$ and amplifier 28 are normally situated outside the sealed enclosure formed by the baseplate structure, the faceplate structure, and outer wall 42. Amplifier 28 can, for example, be part of an integrated circuit situated over the exterior surface of baseplate 38. Input resistor $R_I$ can be part of an integrated circuit situated over the exterior surface of baseplate 38, or can be a discrete resistor situated over the exterior surface of baseplate 38. Similarly comments apply to optional bias voltage sources 30 and 32 when either or both are present.

Figure 6A:
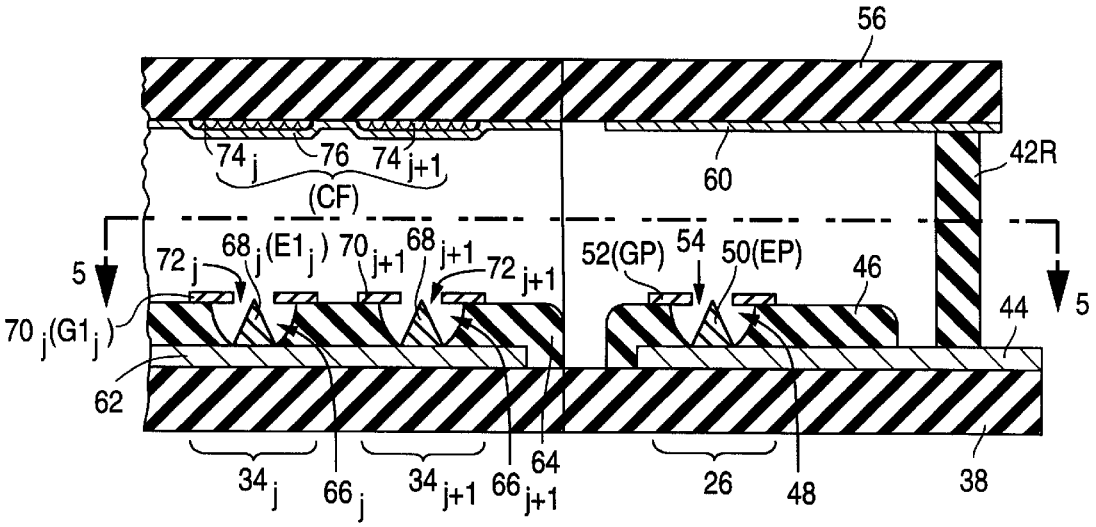
FIGS. 6*a*, 6*b*, and 6*c* cross-sectional views of three ways to implement the triode in the voltage-adjustment section of FIG. 3. The cross sections of FIGS. 6*a*–6*c* are taken through stepped plane 6—6 in FIG. 5. The plan view of FIG. 5 is taken through plane 5—5 in each of FIGS. 6*a*–6*c*.
Figure 6B:
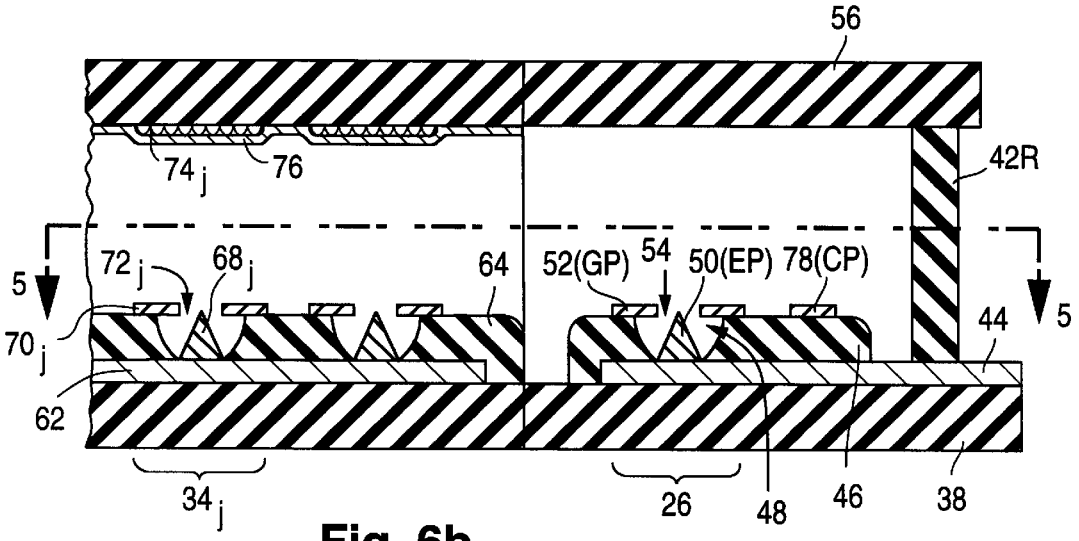
Figure 6C:
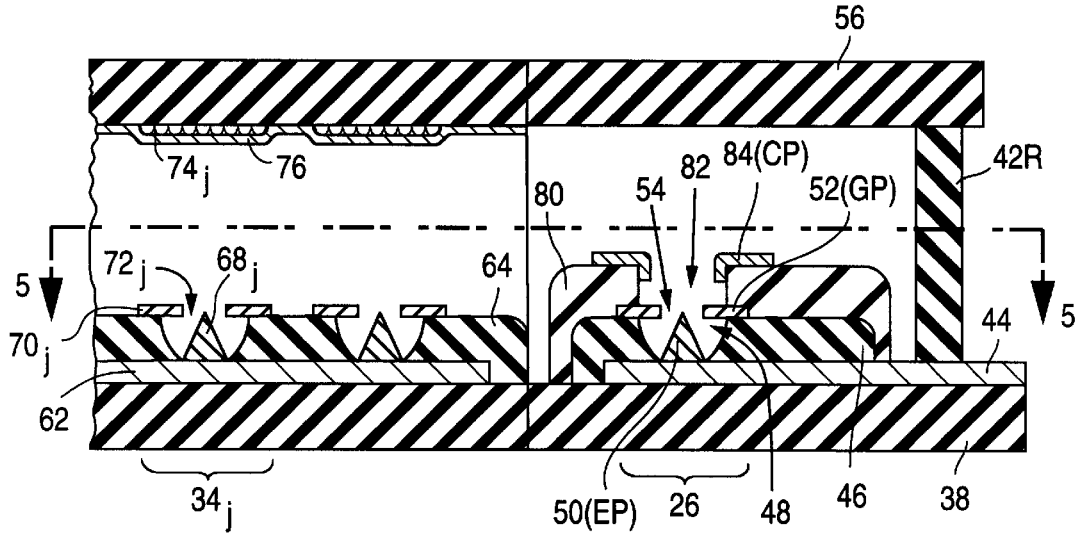

Primary triode 26 can be configured in various ways. FIGS. 6*a*–6*c* illustrate three ways for configuring triode 26 in the FED of FIG. 5. The cross sections of FIGS. 6*a*–6*c* are taken through stepped plane 6—6 in FIG. 5. The scale of illustration is expanded in FIGS. 6*a*–6*c* compared to FIG. 5. The right halves of FIGS. 6*a*–6*c* specifically depict three configurations of triode 26. The left halves of FIG. 6 show part of active area 40 in FIG. 5.

Beginning with the configuration of triode 26 shown in FIG. 6*a,* a primary metal emitter electrode 44 lies over the interior surface of baseplate 38. Emitter electrode 44 passes through right wall 42R so as to be externally accessible. An electrically insulating layer 46, which serves as the inter-electrode dielectric, overlies emitter electrode 44 and extends down to baseplate 38 beyond the side edges of electrode 44.

A group of cavities 48, one of which is shown in FIG. 6*a,* extend through insulating layer 46 down to emitter electrode 44. An electron-emissive element 50, typically consisting of a refractory metal such as molybdenum, is located in each cavity 48 and contacts emitter electrode 44. Electron-emissive elements 50, only one of which is depicted in FIG. 6*a,* form electron emitter EP for triode 26. Electron-emissive elements 50 are typically conical in shape with their tips pointing upward.

A metal gate layer 52 that forms gate electrode GP for all of electron-emissive elements 50 overlies insulating layer 46. Gate electrode 52 passes through outer wall 42 at a location outside the plane of FIG. 6*a.* For example, gate electrode 52 could pass through bottom wall 42B. A gate opening 54 extends through gate electrode 52 above each electron-emissive element 50 to expose that element 50. Although gate electrode 52 is shown as a single line in FIG. 6*a,* electrode 52 typically consists of two or more layers. In a two-layer example, gate openings 54 extend through the lower gate layer, whereas all of gate openings 54 are exposed through a single opening in the upper gate layer.

In the embodiment of FIG. 6*a,* collector CP for triode 26 is part of a faceplate structure connected to outer wall 42. The faceplate structure is created from a transparent faceplate 56 whose exterior surface serves as a viewing area on which an image is visible. Collector CP is formed with a thin electrically conductive layer 60, typically consisting of a light-reflective metal such as aluminum, that lies on the interior surface of faceplate 56 directly across from electron emitter 26. Metal layer 60 passes through right wall 42R so as to be externally accessible.

Linearizing section 20 operates as follows when it is implemented with triode 26 of FIG. 6*a.* Emitter reference voltage $V_{EP}$ and primary gate voltage $V_{GP}$ are respectively applied to emitter electrode 44 and gate electrode 52. Using amplifier 28 and collector bias voltage source 30, metal collector 60 is typically maintained at a high voltage compared to voltages $V_{EP}$ and $V_{GP}$. For example, by setting amplifier reference voltage $V_{AR}$ at approximately zero and by setting collector bias voltage $V_D$ at a value in the range of 75–100 volts, collector 60 is at approximately 75–100 volts. By further setting emitter reference voltage $V_{EP}$ at zero and by setting gate bias voltage $V_B$ at a value in the range of 25–50 volts, collector 60 is roughly 50 volts higher than $V_{GP}$.

When input control voltage $V_I$, is adjusted to such a value as to exceed emitter reference voltage $V_{EP}$ by more than threshold value $V_{TI}$, gate electrode 52 extracts electrons from emitter 50. The high voltage on metal collector 60 attracts electrons towards collector 60. While emitter 50 emits some electrons in directions substantially different from the vertical in FIG. 6*a,* the voltage on collector 60 is sufficient to cause nearly all of the emitted electrons to strike collector 60.

Active area 40 of the FED is configured in an array of rows and columns of pixels (or subpixels in the case of a color FED). Portions of gated display emitters $\mathbf{34}_j$ and $\mathbf{34}_{j+1}$ in two consecutive pixels (or subpixels) of one row of active area 40 are shown in the left half of FIG. 6*a,* where j is a running integer. Each gated emitter $\mathbf{34}_j$ or $\mathbf{34}_{j+1}$ is an implementation of gated emitter 34 in FIG. 3.

A set of parallel display emitter row electrodes 62, one of which is shown in the left half of FIG. 6*a,* extend over baseplate 38 in active area 40 where gated emitters $\mathbf{34}_j$ and $\mathbf{34}_{j+1}$ (collectively "34") are located. Display emitter electrodes 62 pass through left wall 42L and/or right wall 42R at locations outside the view of FIG. 6*a.* Emitter electrodes 62 may be created from the same metal layer as emitter electrode 44. An electrically insulating layer 64, normally part of the same inter-electrode dielectric as insulating layer 46, overlies emitter electrodes 62 and extends down to baseplate 38 beyond the side edges of electrodes 62.

A group of cavities $\mathbf{66}_j$, one of which is shown in FIG. 6*a,* extend through insulating layer 64 at the location of the pixel (or subpixel) for gated emitter 34*j*. Another group of cavities $\mathbf{66}_{j+1}$, one of which is likewise shown in FIG. 6*a,* extend through insulating layer 64 at the location of the pixel (or subpixel) for gated emitter $\mathbf{34}_{j+1}$. Display electron-emissive elements $\mathbf{68}_j$ and $\mathbf{68}_{j+}$, normally consisting of the same material(s) as electron-emissive elements 50, are respectively located in cavities $\mathbf{66}_j$ and $\mathbf{66}_{j+1}$ (collectively "66"). Electron-emissive elements $\mathbf{68}_j$ form display emitter $\mathbf{E1}_j$ for gated electron emitter $\mathbf{34}_j$, while electron-emissive elements $\mathbf{68}_{j+1}$ form display emitter $\mathbf{E1}_{j+1}$ for gated electron emitter $\mathbf{34}_{j+1}$. As with electron-emissive elements 52, electron-emissive elements $\mathbf{68}_j$ and $\mathbf{68}_{j+1}$ (collectively "68") are typically shaped as cones.

A set of parallel metal display gate column electrodes 70, represented by display gate column electrodes $\mathbf{70}_j$ and $\mathbf{70}_{j+1}$ in FIG. 6*a,* extend over insulating layer 64 perpendicular to emitter row electrodes 62. Column electrode $\mathbf{70}_j$ constitutes gate electrode $GP_j$ for gated emitter $\mathbf{34}_j$, while column electrode $\mathbf{70}_{j+1}$ constitutes gate electrode $GP_{j+1}$ for gated emitter $\mathbf{34}_{j+1}$. Column electrodes 70 pass through bottom wall 42B and/or top wall 42T outside the plane of FIG. 6*a*. Although column electrodes 70 are shown as being separate parts of a single layer, they typically consist of parts of two or more layers in the same way as with gate electrode 52 in triode 26. Gate openings $\mathbf{72}_j$ and $\mathbf{72}_{j+1}$ (collectively "72") respectively extend through gate column electrodes $\mathbf{70}_j$ and $\mathbf{70}_{j+1}$ above cavities $\mathbf{66}_j$ and $\mathbf{66}_{j+1}$ to expose display electron-emissive elements $\mathbf{68}_j$ and $\mathbf{68}_{j+1}$.

Phosphor regions $\mathbf{74}_j$ and $\mathbf{74}_{j+1}$ (collectively "74") are situated on the interior surface of faceplate 56 directly across from respective gated emitters $\mathbf{34}_j$ and $\mathbf{34}_{j+1}$. A thin light-reflective layer 76, typically formed from part of the same metal layer as collector layer 60 in triode 26 but spaced apart from collector 60, lies on phosphor regions 74 and extends down to faceplate 56 beyond the side edges of phosphor regions 74. Light-reflective layer 76 passes through outer wall 42 at a location outside the view of FIG. 6*a* so as to be externally accessible. Light-reflective layer 76 and phosphor regions 74 together form display collector CF.

The FED of FIG. 6*a* operates in the following way. Application of appropriate voltages to row electrodes 62 and column electrodes 70 causes electrons to be extracted from electron-emissive elements 68 at selected pixels (or subpixels). Desired levels of electron emission typically occur when the applied gate-to-emitter electric field in active region 40 reaches approximately 20 volts/$\mu$m.

Light-reflective layer 76, to which a suitably high voltage is applied, draws the extracted electrons towards phosphor regions 74 in corresponding pixels (or subpixels) of the faceplate structure. A large fraction of the impinging electrons pass through light-reflective layer 76 and strike phosphor regions 74, causing them to emit light visible on the exterior surface of faceplate 56 to form a desired image. After being struck by an electron that causes light emission, a phosphor region 74 releases an electron which is normally collected by light-reflective layer 76. Collector current $I_{CP}$ is the sum of (a) the electrons collected by layer 74 after being released by phosphor regions 74 and (b) the small fraction of electrons collected directly by layer 76 without striking phosphor regions 76.

Inasmuch as only one implementation of linearizing section 20 is utilized in the embodiment of FIGS. 5 and 6*a*, analog video information for all the gate emitters in active region 40 is processed through linearizer 40 to control the brightness of all the pixels. Alternatively, two or more implementations of voltage-adjustment linearizer 20 can be utilized to control the display brightness. Typically, one implementation of linearizer 20 is provided for each column of pixels (or subpixels) to control the brightness of all the pixels (or subpixels) in that column. In this case, triodes 26 for the multiple implementations of linearizer 20 are typically arranged in a row located in the space between active region 40 and either bottom wall 42B or top wall 42T, rather than being located in a corner of the sealed enclosure as occurs in the layout of FIG. 5 when only one implementation of linearizer 20 is utilized.

Turning to the configuration of triode 26 shown in FIG. 6*b*, emitter EP and gate electrode GP of triode 26 are implemented with electron-emissive elements 50 and gate layer 52 in the same way as in the configuration of FIG. 6*a*. Likewise, electron-emissive elements 50 in FIG. 6*b* are situated in cavities 48 in insulating layer 46 and contact emitter electrode 44 which passes through right wall 42R so that emitter reference voltage $V_{EP}$ can be applied to electron-emissive elements 50. The tips of electron-emissive elements 50 normally extend at least as high as gate openings 54.

An electrically conductive layer 78 that serves as collector CP for triode 26 in FIG. 6*b* lies on insulating layer 46 to the side of gate electrode 52 outside active area 40. While spaced laterally apart from gate layer 52, collector layer 78 is normally relatively close to gate layer 52. If gate electrode 52 is a single layer, gate layer 78 normally consists of the same material as layer 52. If gate electrode 52 consists of two or more layers, collector layer 78 consists of at least one of the materials forming these layers. Collector layer 78 passes through outer wall 42 at a location outside the view of FIG. 6*b*, for example, through bottom wall 42B.

When linearizing section 20 is implemented with triode 26 of FIG. 6*b*, linearizer 20 operates in the following way. As in the configuration of FIG. 6*a*, emitter reference voltage $V_{EP}$ and gate voltage $V_{OP}$ are respectively applied to emitter electrode 50 and gate electrode 52. Amplifier reference voltage $V_{AB}$ again is typically close to zero. By setting collector bias voltage $V_D$ at a value of 50–100 volts, collector 78 is at approximately 50–100 volts. With emitter voltage $V_B$ set at a value of 25–50 volts, collector 78 is roughly 25–50 volts higher than $V_{GP}$.

Raising input control voltage $V_I$ to a value that exceeds emitter reference voltage $V_{EP}$ by more than threshold value $V_{TI}$ causes gate electrode 52 to extract electrons from electron-emissive elements 50, primarily from the tips of elements 50. Since the emitter tips are at least as high as gate openings 54, nearly all of the extracted electrons are emitted into the open space outside cavities 48 and gate openings 54. Due to the high voltage on collector layer 78, nearly all of the electrons emitted into the open space are attracted to collector 78 to form collector current $I_{CP}$. Most of the electrons follow highly curved trajectories in traveling from electron-emissive elements 50 to collector 78.

Figure 7:
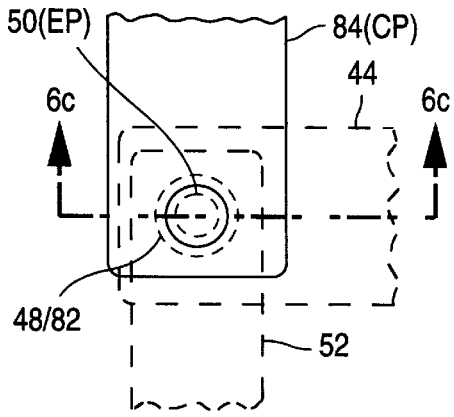
FIG. 7 is a plan view of part of the voltage-adjustment section in the triode of FIG. 6*c*.

Moving to the configuration of triode 26 depicted in FIG. 6*c*, FIG. 7 illustrates the layout of triode 26 in FIG. 6*c*. Components 44, 46, 50, and 52 in triode 26 of FIG. 6*c* are again arranged the same as in the configuration of FIG. 6*a* (or 6*b*). Electron-emissive elements 50 and gate layer 52 in the implementation of FIG. 6*c* respectively form electron-emitter EP and gate electrode GP of triode 26 in FIG. 3.

An electrically insulating layer 80 overlies gate layer 52 and typically extends beyond the side edges of layer 52 at least down to insulating layer 46, typically down to base-plate 38 and primary emitter electrode 44. Openings 82, one of which is shown in FIG. 6*c*, extend through insulating layer 80 above the respective locations of gate openings 54. Each dielectric opening 82 is vertically concentric with underlying gate opening 54. The diameter of each dielectric opening 82 is typically equal to or greater than the diameter of underlying gate opening 54. Consequently, openings 54 and 82 form composite openings 54/82 that expose electron-emissive elements 50.

An electrically conductive layer 84 that lies on insulating layer 80 forms collector CP for triode 26. Part of collector layer 84 extends partway into each dielectric opening 82 as shown in FIG. 6*c*. Although relatively close to gate layer 52, collector layer 84 is spaced vertically apart from layer 52. Collector layer 84 passes through outer wall 42 at a location outside the view of FIG. 6*c*. For example, with reference to FIG. 7, collector layer 84 can extend in the opposite direction from gate layer 52. When gate layer 52 passes through bottom wall 42B, collector layer 84 can continue in the opposite direction from gate layer 52 so as to pass through top wall 42T or can make a right turn and pass through right wall 42R.

Linearizing section 20 operates as follows when it is implemented with triode 26 of FIGS. 6*c* and 7. Voltages $V_{EP}$ and $V_{GP}$ are again respectively applied to emitter electrode 44 and gate electrode 52. Once again, reference voltages $V_{AR}$ and $V_{EP}$ are again typically zero, collector bias voltage $V_D$ is typically 50–100 volts, and gate bias voltage $V_B$ is typically 25–50 volts as in the embodiment of FIG. 6*b*.

Raising input control voltage $V_I$, to a value that enables gate-to-emitter voltage $V_I$-$V_{EP}$ to exceed threshold voltage $V_{TI}$ again causes gate electrode 52 to extract electrons from electron-emissive elements 50. The high voltage on collector layer 84 attracts the extracted electrons upward. Nearly all of the emitted electrons reach collector 84 to form collector current $I_{CP}$.

Active area 40 in the FED of FIG. 6*b* or 6*c* is arranged the same as in the FED of FIG. 6*a*. Accordingly, the FED of FIG. 6*b* or 6*c* operates in the same way as the FED of FIG. 6*a* except for changes relating to the composition and location of display collector CP. Just as multiple implementations of linearizing section 20 can be utilized in the FED of FIG. 6*a*, multiple implementations of linearizer 20 can be employed in the FED of FIG. 6*b* or 6*c*. For the case in which there is one implementation of linearizer 20 for each column of pixels (or subpixels), triodes 26 in the FED of FIG. 6*b* or 6*c* can be arranged in a row located in the space between active area 40 and either bottom wall 42B or top wall 42T.

The components of active area 40 in the left half of each of FIGS. 6*a*–6*c* can be manufactured according to the techniques described in Spindt et al, U.S. Pat. No. 5,559, 389, the contents of which are incorporated by reference herein. The active display components can also be manufactured according to the techniques described in Haven et al, U.S. patent application Ser. No. 08/660,536, filed 7 Jun. 1996, the contents of which are likewise incorporated by reference herein. Components 44, 46, 50, and 52 in the right half of each of FIGS. 6*a*–6*c* are then respectively fabricated at the same time, and using the same materials, as components 62, 64, 68, and 70 in the left half of each of FIGS. 6*a*–6*c*.

For the embodiment of FIG. 6*a*, primary collector 60 is manufactured at the same time, and using the same material, as display collector 76. Primary collector 78 in the embodiment of FIG. 6*b* is created at the same time, and using the same materials, as gate electrodes 52 and 70. In the embodiment of FIG. 6*c*, insulating layer 80 is created by depositing dielectric material on top of gate layer 52 and insulating layer 46 after which undesired parts (if any) of the dielectric material are removed. Openings 82 are created through the so-deposited dielectric material during its formation, or are later etched through the dielectric material. Techniques of the type described in Spindt et al and Haven et al may be employed to achieve alignment of dielectric openings 82 to underlying gate openings 54. Subsequently, collector layer 84 is provided on top of insulating layer 80 by a shallow angle sputtering technique in combination with selective etching.

FIGS. 8*a*–8*h* illustrate eight embodiments of signal conditioning circuitry that employs one or more implementations of linearizing section 20 in converting a video input signal into gate voltages that drive gated emitter array 24 in active area 40. The signal conditioning circuitry contains electrode interface 22 in the embodiments of FIGS. 8*a*, 8*b*, 8*e*, and 8*f*. Electrode interface 22 is absent in the embodiments of FIGS. 8*c*, 8*d*, 8*g*, and 8*h*.

The video input signal may be analog or digital in FIGS. 8*a*–8*h*. In particular, FIGS. 8*a*, 8*c*, 8*e*, and 8*g* present embodiments that process an analog video input signal $V_A$. FIGS. 8*b*, 8*d*, 8*f*, and 8*h* present embodiments that process a digital video input signal $V_D$.

Input voltage $V_I$ provided to, and output voltage $V_O$ provided from, linearizing section 20 are analog signals. Subject to this limitation and subject to the analog or digital nature of the video input signal, the embodiments of FIGS. 8*a*–8*d* largely employ analog signal processing. The embodiments of FIGS. 8*d*–8*h* largely use digital signal processing. The circuitry in each of FIGS. 8*a*–8*h* is suitable for use in an FED.

Gated emitter array 24 in the circuitry of each of FIGS. 8*a*–8*h* consists of M rows by N columns of gated emitters. Two pixel (or subpixel) rows, one consisting of gated display emitters $\mathbf{34}_1$, $\mathbf{34}_2$, . . . $\mathbf{34}_N$ and the other consisting of gated display emitters $\mathbf{36}_1$, $\mathbf{36}_2$, and . . . $\mathbf{36}_N$, are shown in each of FIGS. 8*a*–8*h*. An arbitrary gated emitter in the first row is represented as gated emitter 34*j*, where integer j runs from 1 to N here. An arbitrary gated emitter in the second row is similarly represented as gated emitter $\mathbf{36}_j$. Each of the M rows is a line of video information. The array of M rows and N columns forms a video frame.

Figure 8A:
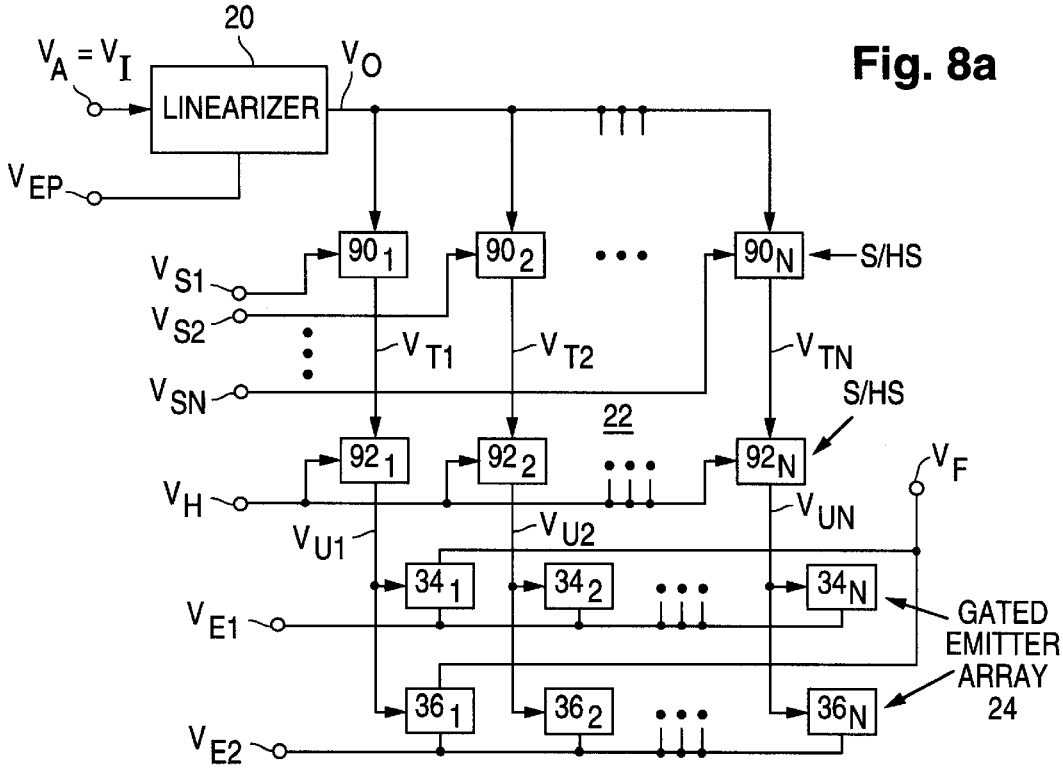

A single implementation of linearizing section 20 is employed in the circuitry of FIG. 8*a*. Analog video input signal $V_A$ is supplied as input control voltage $V_I$ to linearizer 20. Analog video output control voltage $V_O$ from linearizer 20 is furnished to N sample-and-hold ("S/H") circuits $\mathbf{90}_1$, $\mathbf{90}_2$, . . . $\mathbf{90}_N$ in electrode interface 22. S/H circuits $\mathbf{90}_1$-$\mathbf{90}_N$ sequentially sample a line of video output signal $V_O$ in response to N sampling control voltage signals $V_{S1}$, $V_{S2}$, . . . $V_{SN}$ that sequentially go to sampling values during the time period in which video output signal $V_O$ provides a line of video information. S/H circuits $\mathbf{90}_1$-$\mathbf{90}_N$ hold the sampled values of video output signal $V_O$ until just after the $V_O$ value for S/H circuit $\mathbf{90}_N$ is sampled.

After an entire line of $V_O$ video information is sampled, S/H circuits $\mathbf{90}_1$-$\mathbf{90}_N$ provide N first sample voltage signals $V_{T1}$, $V_{T2}$, . . . $V_{TN}$ at the N sampled values of video output signal $V_O$. Sample voltages $V_{T1}$-$VT_{TN}$ are supplied to N sample-and-hold circuits $\mathbf{92}_1$, $\mathbf{92}_2$, . . . $\mathbf{92}_N$ in electrode interface 22. S/H circuits $\mathbf{92}_1$-$\mathbf{92}_N$ respectively simultaneously sample first sample voltages $V_{T1}$-$V_{TN}$ in response to a common sampling control voltage signal $V_H$. S/H circuits $\mathbf{92}_1$-$\mathbf{92}_N$ thus hold the current values of a line of $V_O$ video information while S/H circuits $\mathbf{90}_1$31 $\mathbf{90}_N$ are holding the next line of $V_O$ video information. After sampling the current line of $V_O$ video information, S/H circuits $\mathbf{92}_1$-$\mathbf{92}_N$ provide N respective second sample voltage signals $V_{U1}$, $VU_2$, . . . $V_{UN}$ at the values of the current video line for a time period approximately equal to the time needed for S/H circuits $\mathbf{90}_1$-$\mathbf{90}_N$ to sample the next video line.

Each second sample voltage $V_{Uj}$ is supplied to the gate electrodes of gated display emitters $\mathbf{34}_j$ and $\mathbf{36}_j$ and the other display gated emitters in column j of array 24. Each sample voltage $V_{Uj}$ in FIG. 8*a* thus corresponds to additional control voltage $V_U$ in FIG. 3. Accordingly, sample voltages $V_{U1}$-$V_{UN}$ are at suitable non-linear values relative to analog input voltage $V_A$ (input control voltage $V_1$) so that the collector current from the gated emitters in array 24 varies approximately linearly with each consecutive value of analog video input signal $V_A$. A change in the analog value of video input signal $V_A$ causes an approximately linear change in the display brightness.

Figure 8B:
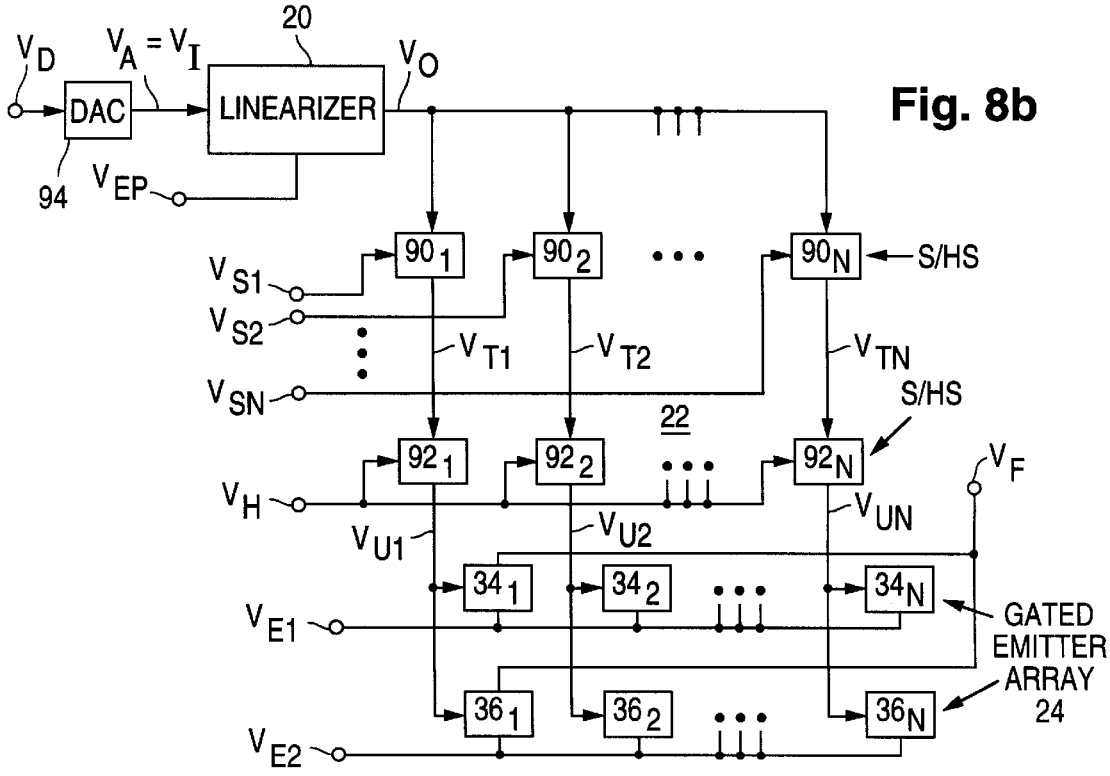

The circuitry of FIG. 8*b* is the same as that of FIG. 8*a* except for the addition of a digital-to-analog converter ("DAC") 94. Digital video input signal $V_D$ is provided to the circuitry of FIG. 8*b*. DAC 94 converts digital input signal $V_D$ into analog video input signal $V_A$ supplied to the single implementation of linearizing section 20. Electrode interface 22 in the circuit of FIG. 8*b* contains S/H circuits $\mathbf{90}_1$-$\mathbf{90}_N$ and $92_1$-$92_N$ which process analog video output signal $V_O$ from linearizer 20 in the same way as in the circuitry of FIG. 8*a*.

The circuitry of FIG. 8*c* is a variation of the circuitry of FIG. 8*a* in which S/H circuits $90_1$-$90_N$ and $92_1$-$92_N$ process analog video input signal $V_A$ before gamma characteristic linearization is performed on signal $V_A$. Except for the fact that S/H circuits $90_1$-$90_N$ receive analog video input signal $V_A$ rather than analog video output signal $V_O$, S/H circuits $90_1$-$90_N$ and $92_1$-$92_N$ operate the same in the circuitry of FIG. 8*c* as in the circuitry of FIG. 8*a*.

After simultaneously sampling the current line of video information, S/H circuits $92_1$-$92_N$ provide N respective second sample voltage signals $V_{I1}$, $V_{I2}$, . . . $V_{IN}$ at the values of the current video line for a time period approximately equal to the time needed for S/H circuits $90_1$-$90_N$ to sequentially sample the next video line. Each second sample voltage $V_{ij}$ corresponds to input control voltage $V_I$ supplied to linearizing section 20 in FIG. 3. Sample voltages $V_{I1}$-$V_{IN}$ are respectively provided to N implementations $20_1$, $20_2$, . . . $2O_N$ of linearizer 20. Responsive to sample voltages $V_{I1}$-$V_{IN}$, linearizer sections $20_1$-$20_N$ provide N video output control voltage signals $V_{O1}$, $V_{O2}$, . . . $V_{ON}$.

Each output control voltage signal $V_{Oj}$ corresponds to output voltage $V_O$ provided from linearizing section 20 in FIG. 3. Since electrode interface 22 is absent in the circuitry of FIG. 8*c*, output control voltages $V_{O1}$-$V_{ON}$ respectively constitute additional control voltages $V_{U1}$-$V_{UN}$ provided to gated emitter array 24 in the same way as in the circuitry of FIG. 8*a*. Output voltages $V_{O1}$-$V_{ON}$ are at suitable non-linear values relative to analog input video signal $V_A$ that the collector current from the gated emitters in array 24 varies linearly with each consecutive sampled value of signal $V_A$. A change in the analog value of video input signal $V_A$ causes a linear change in the display brightness.

The circuitry of FIG. 8*d* is the same as that of FIG. 8*c* except for the addition of DAC 94 that receives digital video input signal $V_D$. DAC 94 converts digital input signal $V_D$ into analog video input signal $V_A$. S/H circuits $90_1$-$90_N$ sequentially sample video signal $V_A$ in the circuitry of FIG. 8*d* after which S/H circuits $92_1$-$92_N$ simultaneously sample first sample voltages $V_{T1}$-$V_{TN}$ from S/H circuits $90_1$-$90_N$ in the same way as in the circuitry of FIG. 8*c*. With electrode interface 22 being absent in the circuitry of FIG. 8*d*, output control voltages $V_{O1}$-$V_{ON}$ respectively constitute additional control voltages $V_{U1}$-$V_{UN}$ provided to gated emitter array 24.

Figure 8E:
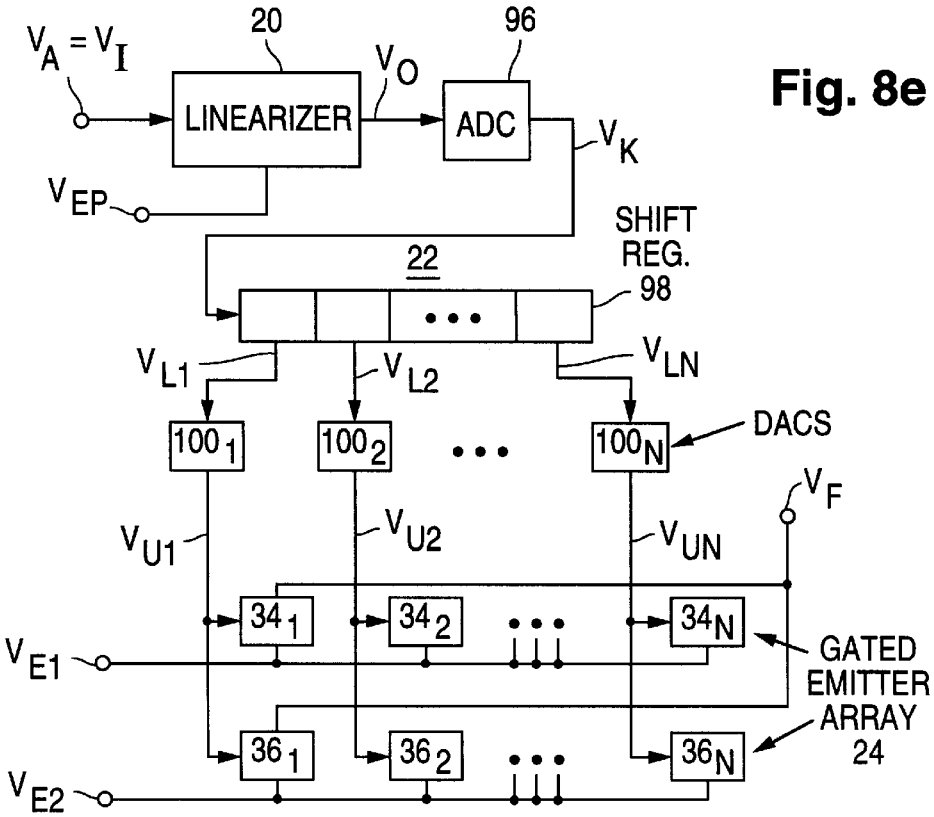

A single implementation of linearizing section 20 is again utilized in the circuitry of FIG. 8*e*. Analog video input signal $V_A$ is furnished as input control voltage $V_I$ to linearizer 20. An analog-to-digital converter ("ADC") 96 in electrode interface 22 converts output control voltage $V_O$ from linearizer 20 into a digital signal $V_K$. A video line formed with N consecutive values of digital signal $V_K$ is sequentially loaded into a shift register 98 in electrode interface 22 as a previous line of $V_K$ video information is shifted out of shift register 98.

Shift register 98 has N storage locations for the N digital values of each line of $V_K$ video information. When the current line of digital signal $V_K$ is loaded into shift register 98, the N $V_K$ storage locations respectively provide the N stored $V_K$ values as N digital shift register signals $V_{L1}$, $V_{L2}$, . . . $V_{LN}$ to N digital-to-analog converters $100_1$, $100_2$, . . . $100_N$ in electrode interface 22. DACs $100_1$-$100_N$ convert shift register signals $V_{L1}$-$V_{LN}$ into additional control voltages $V_{U1}$31 $V_{UN}$ at the analog values of the current $V_K$ video line.

Each additional control voltage $V_{Uj}$ in the circuitry of FIG. 8*e* is furnished to the gate electrodes of gated display emitters $34_j$, and $36_j$ and the other display gated emitters in column j of array 24 just as is done in the circuitry of FIG. 8*a*. Control voltages $V_{U1}$31 $V_{UN}$ in the circuitry of FIG. 8*e* are thus at suitable non-linear values relative to analog input video signal $V_A$ (input control voltage $V_1$) such that the collector current from the gated emitters in array 24 varies in an approximately linear manner with each consecutive value of analog input signal $V_A$. A change in the analog value of video input signal $V_A$ again causes an approximately linear change in the display brightness.

Figure 8F:
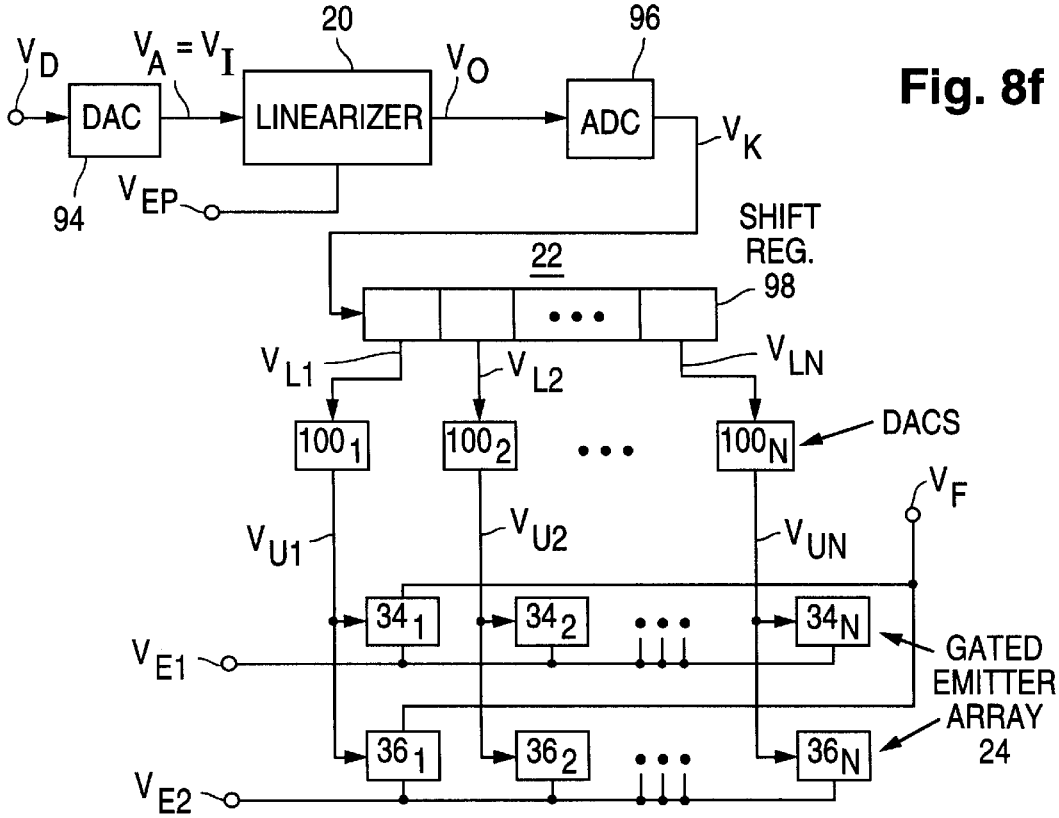

The circuitry of FIG. 8*f* is the same as that of FIG. 8*e* except for the addition of DAC 94. Digital video input signal $V_D$ is furnished to DAC 94 in the circuitry of FIG. 8*f*. DAC 94 converts digital signal $V_D$ into analog video input signal $V_A$ furnished to the single implementation of linearizing section 20. Electrode interface 22 in the circuitry of FIG. 8*f* contains ADC 96, shift register 98, and DACs $100_1$-$100_N$ which process output control voltage $V_O$ from linearizer 20 in the same way as in the circuitry of FIG. 8*e*.

Figure 8G:
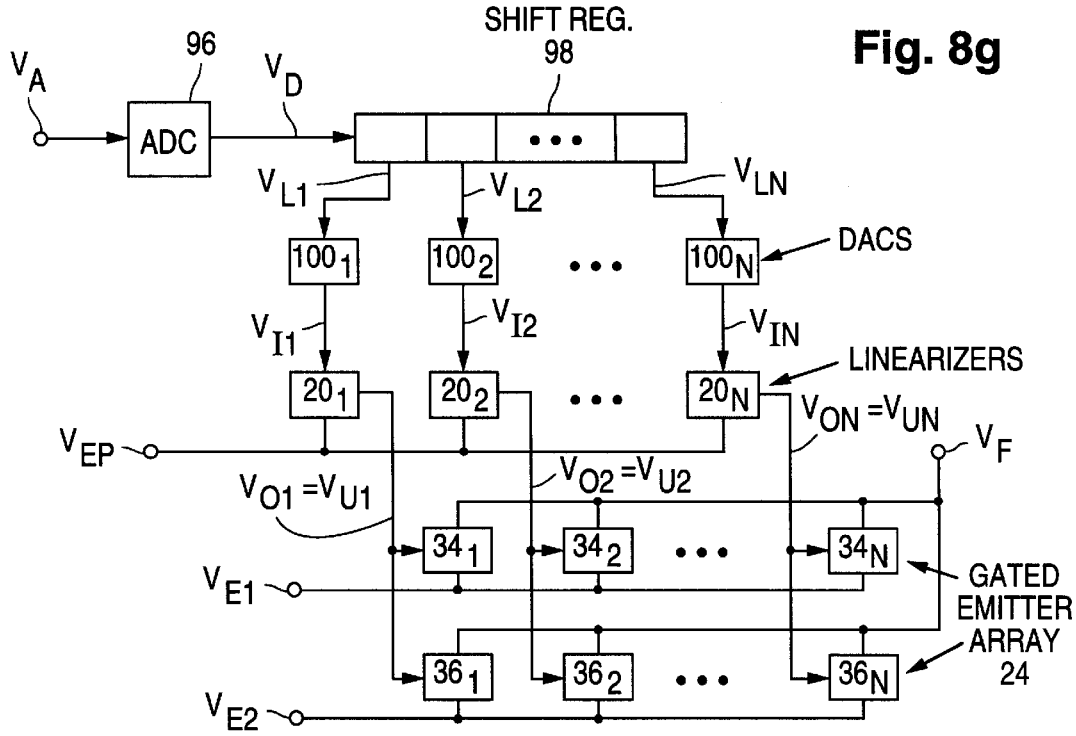

The circuitry of FIG. 8*g* is a variation of the circuitry of FIG. 8*e* in which ADC 96, shift register 98, and DACs $100_1$-$100_N$ process analog video input signal $V_A$ before gamma characteristic linearization is performed on signal $V_A$. Except for the fact that ADC 96 receives analog video input signal $V_A$ rather than input control voltage $V_O$, components 96, 98, and $100_1$-$100_N$ in the circuitry of FIG. 8*g* operate the same as in the circuitry of FIG. 8*e*.

After the current line of $V_A$ analog video information is converted by ADC 96 into digital form and is shifted into shift register 98, DACs $100_1$-$100_N$ convert shift register signals $V_1$-$V_{LN}$ respectively into analog input control voltages $V_{I1}$-$V_{IN}$. Each analog input control voltage $V_{Ij}$ corresponds to input control voltage $V_I$ furnished to linearizer section 20 in FIG. 3. Input control voltages $V_{I1}$ $V_{IN}$ are respectively supplied to N implementations $20_1$-$20_N$ of linearizer 20. In response, linearizers $20_1$-$20_N$ provide N output control voltages $V_{O1}$-$V_{ON}$.

As in the circuitry of FIG. 8*c*, each output control voltage $V_{Oj}$ in the circuitry of FIG. 8*g* corresponds to output control voltage $V_O$ generated by linearizing section 20 in FIG. 3. Since electrode interface 22 is absent in the circuitry of FIG. 8*g*, output control voltages $V_{O1}$-$V_{ON}$ constitute additional control voltages $V_{U1}$31 $V_{UN}$ provided to gated emitter array 24 in the same way as in the circuitry of FIG. 8*c*. Accordingly, output control voltages $V_{O1}$-$V_{ON}$ are generated at such non-linear values relative to analog video input signal $V_A$ that the collector current from the gated emitters in array 24 varies approximately linearly with each consecutive value of signal $V_A$.As a consequence, changing analog video input signal $V_A$ causes an approximately linear change in the display brightness.

Figure 8H:
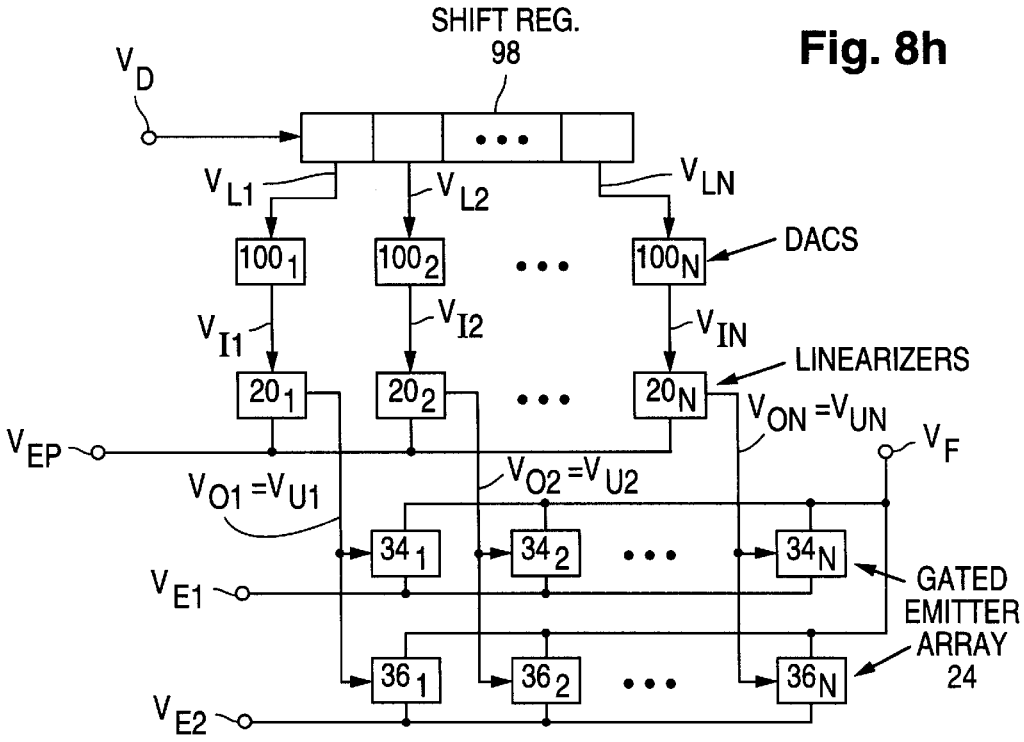

The circuitry of FIG. 8*h* is the same as that of FIG. 8*g* except for the deletion of ADC 96. The video input signal to the circuitry of FIG. 8*h* is digital signal $V_D$. Shift register 98 and DACs $100_1$-$100_N$ in the circuitry of FIG. 8*h* convert digital video input signal $V_D$ into analog input control voltages $V_{I1}$-$V_{IN}$ in the same way as in the circuitry of FIG. 8*g*. With electrode interface 22 being absent in the circuitry of FIG. 8*h*, analog control voltages $V_{O1}$-$V_{ON}$ respectively constitute additional control voltages $V_{U1}$-$V_{UN}$ furnished to gated emitter array 24.

Active region 40 in a FED typically includes other components not shown in FIGS. 6*a*–6*c*. For example, a black matrix situated along the interior surface of faceplate 56 typically surrounds each display phosphor region 74 to laterally separate it from other phosphor regions 74. Focussing ridges provided over inter-electrode dielectric layer 64 help control the trajectories of electrons emitted from display emitters 68. Spacers are utilized to maintain a relatively constant spacing between baseplate 38 and faceplate 56 and to provide structural strength to the evacuated FED.

Directional terms such as "top", "bottom", "right", "left" and the like have been employed in describing the present invention to establish a frame of reference by which the reader can understand how the various parts of an FED fit together. In actual practice, the components of an FED may be situated at orientations different from that implied by the directional terms used here. Inasmuch as directional terms are used for convenience to facilitate the description, the invention encompasses implementations in which the orientations differ from those strictly covered by the directional terms utilized here.

While the invention has been described with particular embodiments, this description is solely for the purpose of illustration and is not to be construed as limiting the scope of the invention claimed below. For example, the electron-emissive elements that form primary electron emitter EP and the display emitters in array 24 can have shapes other than cones. Creating the electron-emissive elements as filaments, for example, in the manner described in Spindt et al cited above, may be desirable in some applications. Each of electron emitters EP and the display electron emitters can be a single electron emitter rather than a group of electron-emissive elements.

Collector CF in active region 40 can consist of a thin layer of electrically conductive transparent material, such as indium tin oxide, covered with phosphor regions. Collector CF can also be a fine metal mesh structure. Various modifications and applications may thus be made by those skilled in the art without departing from the true scope and spirit of the invention as defined in the appended claims.

We claim:

1. An electronic device comprising a voltage-adjustment section for converting an input control voltage into an output control voltage, the voltage-adjustment section comprising:

an input portion responsive to the input control voltage for providing an input control current to an input node;

a primary emission/collection cell having (a) a primary emitter coupled to a source of an emitter reference voltage for emitting electrons into space, (b) a primary collector coupled to the input node for carrying a primary collector current formed with electrons emitted from the primary emitter, and (c) a primary gate electrode for controlling the primary collector current as a function of the output control voltage; and an amplifier having a first amplifier input terminal coupled to the input node, a second amplifier input terminal coupled to a source of an amplifier reference voltage, and an amplifier output terminal coupled to the primary gate electrode for providing the output control voltage as an amplification of the difference between signals at the amplifier input terminals.

2. A device as in claim 1 wherein the primary collector current varies in an approximately linear manner with the input control voltage.

3. A device as in claim 2 wherein the amplifier has a high gain.

4. A device as in claim 3 wherein the gain of the amplifier is at least 1000.

5. A device as in claim 4 wherein the amplifier comprises an operational amplifier.

6. A device as in claim 3 wherein the primary collector current varies approximately linearly with the input control current.

7. A device as in claim 2 wherein the input portion comprises a resistor coupled between a section input terminal and the input node.

8. A device as in claim 2 wherein the emitter and amplifier reference voltages are substantially constant.

9. A device as in claim 2 further including a gate bias voltage supply coupled between the primary gate electrode and the amplifier output terminal.

10. A device as in claim 2 further including a collector bias voltage supply coupled between the primary collector and the input node.

11. A device as in claim 1 wherein the primary emitter comprises multiple electron-emissive elements.

12. A device as in claim 1 further including an additional emission/collection cell having an additional emitter for emitting electrons into space, an additional collector for carrying an additional collector current formed with electrons emitted from the additional emitter, and an additional gate electrode for controlling the additional collector current as a function of the output control voltage.

13. A device as in claim 12 wherein the output control voltage is provided to the gate electrode of the additional cell.

14. A device as in claim 12 further including an electrode interface for converting the output control voltage into an additional control voltage provided to the gate electrode of the additional cell.

15. A device as in claim 1 further including:

a baseplate structure that comprises (a) a baseplate having an interior surface, (b) a display emitter situated over the interior surface of the baseplate for emitting electrons into space to form a collector current, and (c) a display gate electrode situated over, and electrically insulated from, the display emitter for controlling the collector current as a function of the output control voltage; and a faceplate structure that comprises (a) a faceplate having an interior surface that faces the interior surface of the baseplate, (b) a light emitter for emitting light upon being struck by electrons emitted from the display emitter, and (c) a display collector for collecting the collector current.

16. A device as in claim 15 wherein the primary collector current varies in an approximately linear manner with the input control voltage.

17. A device as in claim 16 wherein the output control voltage is provided to the display gate electrode.

18. A device as in claim 16 further including an electrode interface for converting the output control voltage into an additional control voltage provided to the display gate electrode.

19. A device as in claim 1 further including:

a plurality of first sample-and-hold circuits for sequentially sampling the output control voltage and holding sampled values of the output control voltage to produce a like plurality of first sample voltages, the input control voltage being an analog input signal;

a like plurality of second sample-and-hold circuits for simultaneously respectively sampling the first sample voltages and holding sampled values of the first sample voltages to produce a like plurality of second sample voltages;

multiple groups of a like plurality of display emission cells, each having (a) a display emitter for emitting electrons into space to form a display collector current and (b) a display gate electrode for controlling the display collector current, the gate electrodes in each of the pluralities of the display cells being respectively responsive to the second sample voltages; and at least one display collector for collecting the display collector currents.

20. A device as in claim 19 further including a digital-to-analog converter for converting a digital input signal into the input control voltage.

21. A device as in claim 1 further including:

a plurality of first sample-and-hold circuits for sequentially sampling an analog input signal and holding sample values of the analog input signal to produce a like plurality of first sample voltages;

a like plurality of second sample-and-hold circuits for simultaneously respectively sampling the first sample voltages and holding sampled values of the first sample voltages to produce a like plurality of second sample voltages;

at least one further voltage-adjustment section having an input portion, a primary emission/collection cell, and an amplifier configured as in the first-mentioned voltage-adjustment section such that there are a like plurality of voltage-adjustment sections, the second sample voltages being supplied to the voltage-adjustment sections respectively as their input control voltages;

multiple groups of a like plurality of display emission cells, each having (a) a display emitter for emitting electrons into space to form a display collector current and (b) a display gate electrode for controlling the display collector current, the gate electrodes in each of the pluralities of the display cells being responsive to the second sample voltages; and at least one display collector for collecting the display collector currents.

22. A device as in claim 21 further including a digital-to-analog converter for converting a digital input signal into the analog input signal.

23. A device as in claim 1 further including:

an analog-to-digital converter for converting the output control voltage, as an analog signal, into a digital circuit signal, the input control voltage being an analog signal;

a shift register into which a plurality of values of the digital circuit signal are loadable to produce a like plurality of shift register signals;

a like plurality of digital-to-analog converters for simultaneously converting the shift register signals into a like plurality of analog circuit signals;

multiple groups of a like plurality of display emission cells, each having (a) a display emitter for emitting electrons into space to form a display collector current and (b) a display gate electrode for controlling the display collector current, the gate electrodes in each of the pluralities of the display cells being responsive to the analog circuit signals; and at least one display collector for collecting the display collector currents.

24. A device as in claim 23 further including a digital-to-analog converter for converting a digital input signal into the input control voltage.

25. A device as in claim 1 further including:

a shift register into which a plurality of values of a digital input signal are loadable to produce a like plurality of shift register signals;

a like plurality of digital-to-analog converters for simultaneously converting the shift register signals into a like plurality of analog circuit signals;

at least one further voltage-adjustment section having an input portion, a primary emission/collection cell, and an amplifier configured as in the first-mentioned voltage adjustment section such that there are a like plurality of voltage-adjustment sections, the analog circuit signals being respectively supplied to the voltage-adjustment sections as their input control voltages;

multiple groups of a like plurality of display emission cells, each having (a) a display emitter for emitting electrons into space to form a display collector current and (b) a display gate electrode for controlling the display collector current, the gate electrodes in each of the pluralities of the display cells being respectively responsive to the output control voltages; and at least one display collector for collecting the display collector current.

26. A device as in claim 25 further including an analog-to-digital converter for converting an analog input signal into the digital input signal.

27. A device as in claim 1 further including:

a faceplate structure comprising a transparent faceplate having an interior surface; and a baseplate structure comprising the primary emitter, the primary gate electrode, a baseplate having an interior surface that faces the interior surface of the faceplate, and a primary emitter electrode situated over the interior surface of the baseplate, the primary emitter comprising at least one electron-emissive element situated over the primary emitter electrode, the gate electrode (a) overlying the primary emitter electrode, (b) being spaced vertically apart from the primary emitter electrode, and (c) having at least one opening to expose each electron-emissive element.

28. A device as in claim 27 wherein the primary collector is part of the faceplate structure and overlies the interior surface of the faceplate.

29. A device as in claim 27 wherein the primary collector is part of the baseplate structure, overlies the interior surface of the baseplate, is spaced vertically apart from the primary emitter electrode, and is spaced laterally apart from the primary gate electrode.

30. A device as in claim 27 wherein the primary collector is part of the baseplate structure, overlies the primary gate electrode, and is spaced vertically apart from the primary gate electrode.

* * * * *